United States Patent [19]

Votteler et al.

[11] Patent Number: 4,553,483

[45] Date of Patent: Nov. 19, 1985

[54] WORKTABLE, ESPECIALLY OFFICE TABLE

[75] Inventors: Arno Votteler, Stuttgart, Fed. Rep. of Germany; Max Lanuzzi, Weisslingen, Switzerland; Fredi Dubach, Adetswil, Switzerland; Herbert Schreiner, Frauenfeld, Switzerland

[73] Assignee: Planmöbel Eggersmann GmbH & Co. KG, Espelkamp, Fed. Rep. of Germany

[21] Appl. No.: 398,347

[22] Filed: Jul. 15, 1982

[30] Foreign Application Priority Data

Jul. 16, 1981 [DE] Fed. Rep. of Germany ..... 3128137

[51] Int. Cl.[4] ..... A47F 5/12

[52] U.S. Cl. ..... 108/4; 248/188.2; 108/1

[58] Field of Search ..... 108/1, 4, 144, 145, 108/12; 211/182, 186; 248/157, 188.2, 396

[56] References Cited

U.S. PATENT DOCUMENTS

| | | | |
|---|---|---|---|
| 1,104,675 | 7/1914 | Kilberg et al. | 108/4 |
| 3,421,457 | 1/1969 | Taylor et al. | 108/4 |
| 3,744,845 | 7/1973 | Sooker | 108/12 |
| 4,285,281 | 8/1981 | Frick | 108/144 X |

*Primary Examiner*—William E. Lyddane
*Assistant Examiner*—Peter A. Aschenbrenner
*Attorney, Agent, or Firm*—Becker & Becker, Inc.

[57] ABSTRACT

A worktable, especially an office table, which includes two side legs, at least one support bar which connects these legs, and a table-top. Also provided are rigidly interconnected support, connecting and fastening structures which permit different height positions and inclinations of the table-top with the aid of simple tools. The connecting, support, and fastening structures save space, and give the table the necessary stability and freedom from vibration. For this purpose, the fastening plates have holes which are equally spaced from, and are rotationally symmetrical to, the middle point of the plate. The bars have at least two fastening and support surfaces for the table-top and are eccentrically connected with the fastening plates in such a manner that in different rotary positions of the two plates, the fastening and support surfaces of the bars are located at different levels or height positions. The table legs have threaded holes arranged to correspond with the fastening holes of the plate. The table-top is held directly on the support bars by fastening structure on the underside of the table-top.

9 Claims, 9 Drawing Figures

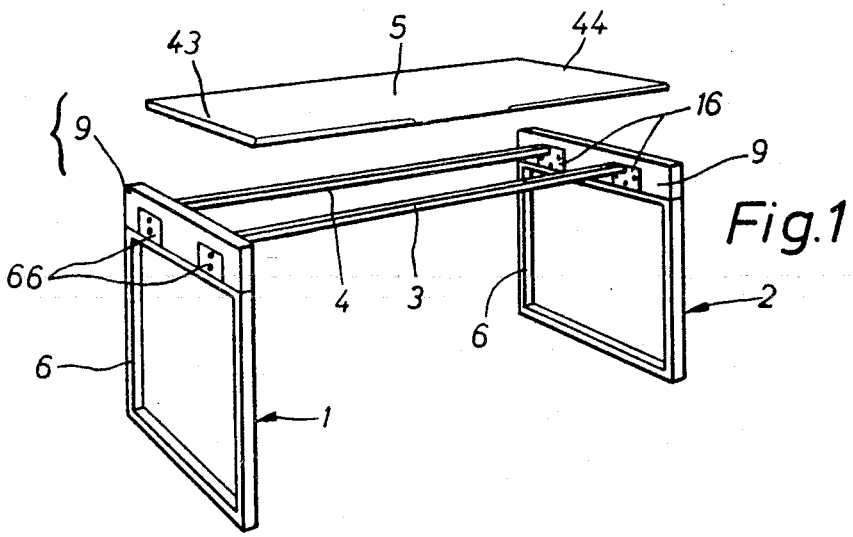
Fig.1
Fig.2
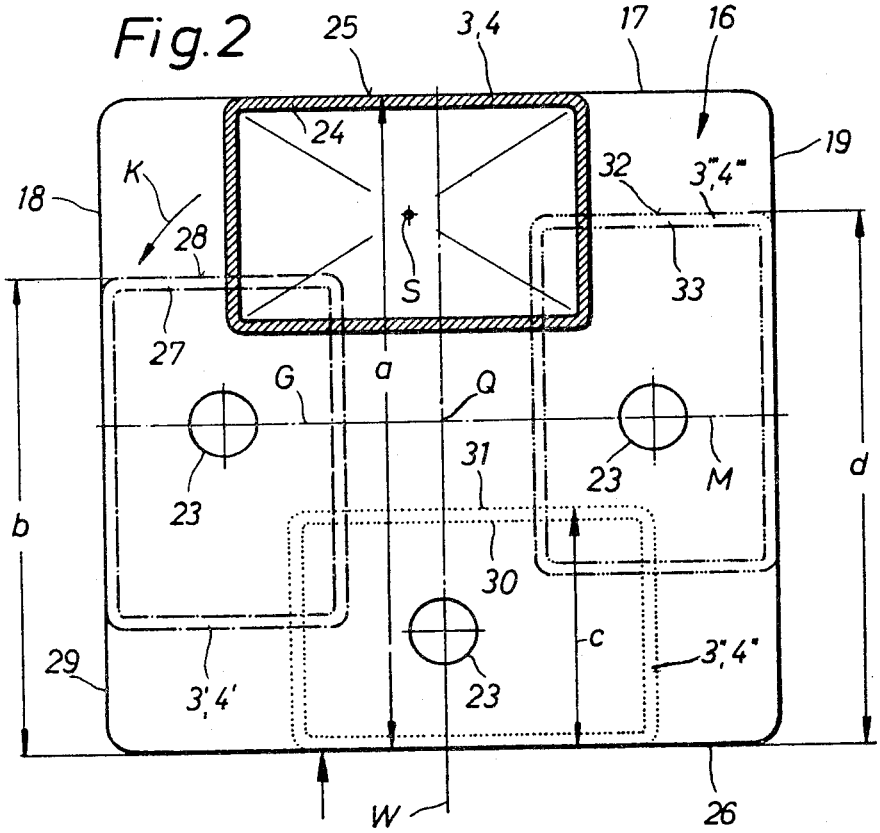

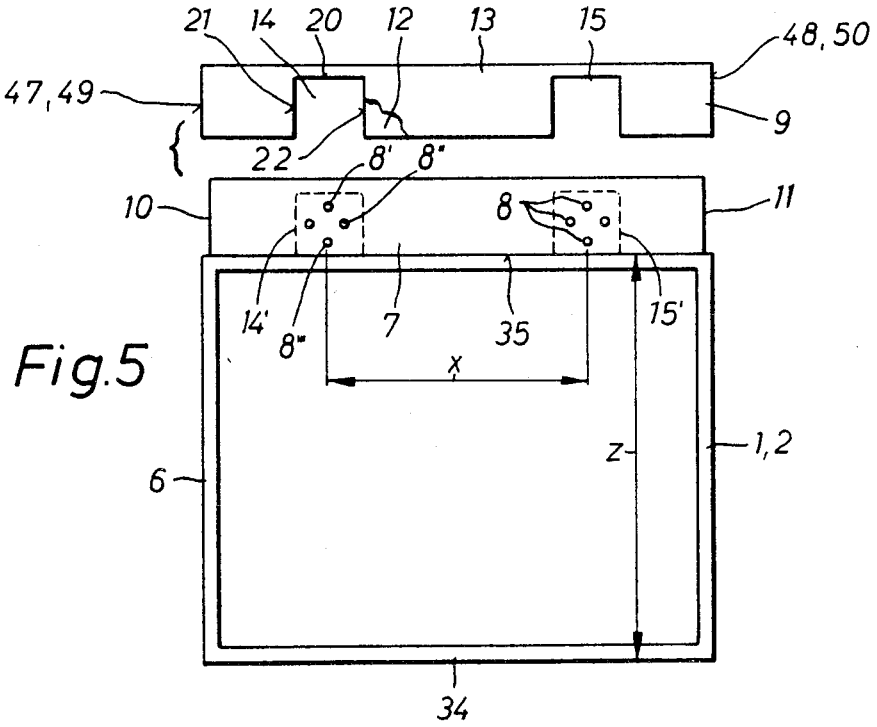
Fig.5
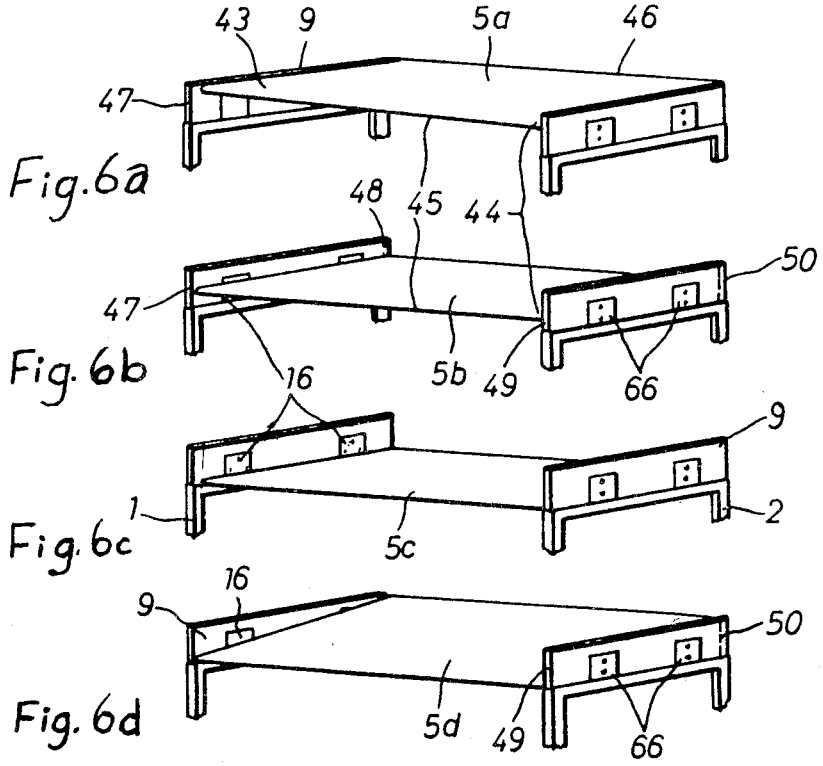
Fig.6a
Fig. 6b
Fig. 6c
Fig. 6d

WORKTABLE, ESPECIALLY OFFICE TABLE

The present invention relates to a worktable or workbench, especially an office table, and includes two side walls or legs; at least one bar which rigidly connects these legs and has fastening plates on its ends arranged at right angles to the bar axis; and a table-top.

German Gebrauchsmuster No. 8,000,787 discloses a table of this type, and has a height or level adjustable table-top and two table legs; height adjustment is effected by rotating two support discs, which are provided with support surfaces, about a double eccentric axis of rotation. This known embodiment does not result in a worktable having few parts which are rigidly connected with each other; rather, the known embodiment requires a sliding guide or guidance of the legs of the height adjustable table-top at two supports on the table sides, with a counter support surface for the support discs. Furthermore, additional holding means are required to secure the table-top against shifting transverse to its longitudinal extension in the different height positions. The known embodiment requires a strong and bulky construction of its parts, or requires additional means in order to attain the necessary stability and freedom from vibration.

It is an object of the present invention, compared with the worktable of the prior art, to attain not only different height of level positions and inclined positions of the table-top with simpler means, but rather to make possible at least two, preferably three or even four, different table heights or levels with the same rigid connecting, support, and fastening means, with the adjustment to the different table heights or levels being rapidly possible with simple tools. Furthermore, the connecting, support, and fastening means should be space saving and compact, yet must provide the table with the necessary stability and freedom from vibration. The table-top must always be able to occupy the same accurate edge position with respect to the legs in spite of the height or level adjustment capability. Furthermore, two adjoining table-tops should be capable of being held on a common support leg along their adjoining transverse edges.

These objects, and other objects and advantages of the present invention, will appear more clearly from the following specification in connection with the accompanying drawings, in which:

FIG. 1 is a perspective view of one embodiment of the inventive table, with the table-top lifted up;

FIG. 2 is a section through a support bar having a bracket or fastening place at one end thereof;

FIG. 5 shows the side walls or legs of the table, with an upper hood-like cover; and FIGS. *6a, 6b, 6c* and *6d* illustrate different positions of the table-top relative to the side walls.

Figure 3:
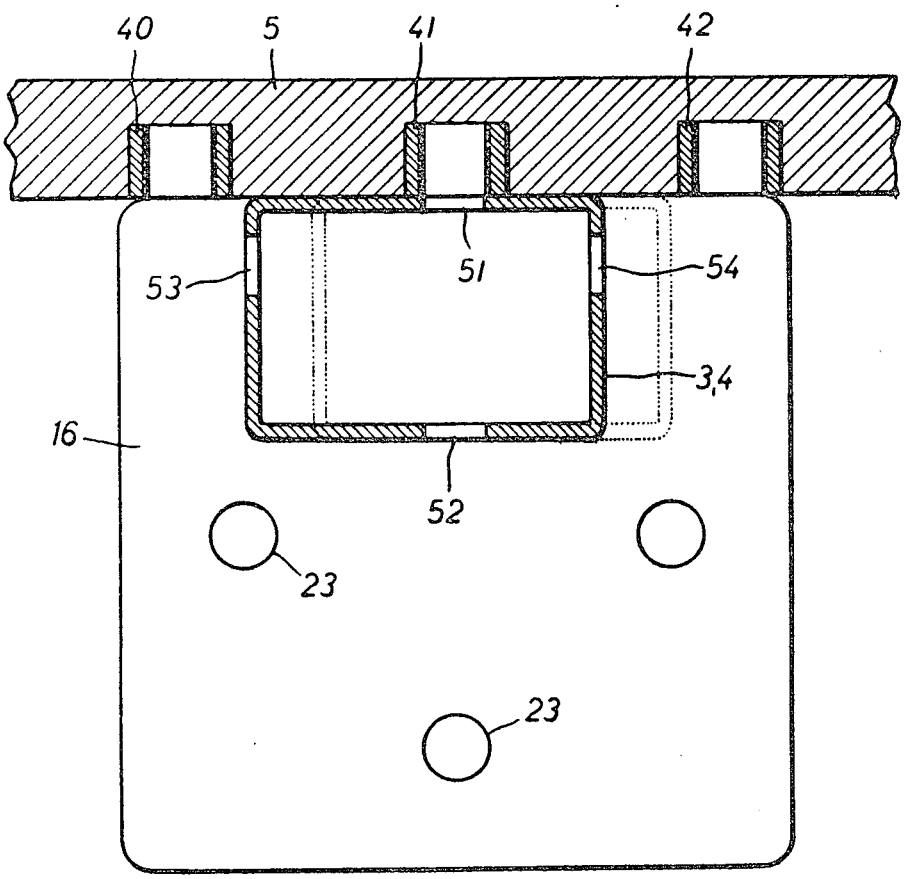
FIG. 3 illustrates a portion of the table-top resting on a support bar, with threaded sleeves provided on the underside of the table-top, and with a fastening plate.

The worktable of the present invention is characterized primarily in that the fastening plates have holes which are equally spaced from, and are rotationally symmetrical to, the middle point of the plate, with the centers of said holes lying on an imaginary circle of symmetry, and with a given one of said holes being equidistant from its adjacent holes as viewed along said imaginary circle of symmetry; the bars have at least two fastening and support surfaces for the table-top, and are eccentrically connected with the fastening plates in such a manner that in different rotary positions of the two plates, the fastening and support surfaces of the bars are located at different levels or height positions; the table legs have threaded holes arranged to correspond with the fastening holes of the plate; and the table-top is held directly on the bar by fastening means on the underside of the table-top.

Further improvements and developments of the present invention are as follows. The support bars may have a rectangular cross section. The fastening plates may be quadratic or square, and the fastening holes thereof may be arranged in the shape of a triangle, the base line of which coincides with the middle line of the plate.

At least two support surfaces of the support bars may extend parallel to the sides edges of the plate.

Those walls of the support bar which form the support surfaces may have oppositely located bores for the fastening means of the table-top.

The underside of the table-top may be provided with threaded sleeves for the fastening means of the table-top on the support bars. The oppositely located fastening and support surfaces of the support bars may have at least partially aligned holes or bores.

With a rectangular cross section of the support bars and a double eccentric arrangement thereof on the fastening plates at their ends, the underside of the table may have three threaded sleeves, the spacing of which from the longitudinal edges of the table corresponds to the same spacing of the bores in the walls of the support bars in their different rotary positions.

The support surfaces of the support bars which may carry wedge-shaped intermediate pieces, and the bores in the support bars may be elongated holes.

The advantage of the worktable according to the present invention is that by utilizing the same strong parts for all height or level positions of the table-top, a small storage space is possible; furthermore, the transporting costs can be reduced compared with those of previously known embodiments. In addition, the parts of the worktable according to the present invention offer the possibility of easy replacement and interchangeability with other height-adjustment devices having similar fastening plates. Mounting plates at different heights and inclinations is made possible by using several supports. Rigid connection of all parts assures a high stability and freedom from vibration.

Referring now to the drawings in detail, the workbench or worktable in the illustrated example essentially comprises two side walls or legs 1, 2, two support bars or rods 3,4 connecting the two side walls 1,2 and the table-top 5, all of which are rigidly connected with each other. The legs 1,2 preferably have a lower frame portion 6, and are constructed identically. As recognizable from FIG. 5, a strip-like head part of headpiece 7 is provided above the rectangular or square frame portion 6. In the illustrated example, the headpiece has two groups of four respectively quadratically arranged tapped or threaded holes 8, with the two groups being spaced apart by an average distance x, and with each quadratic configuration standing on one of its apexes, i.e., in a given group of holes 8, the connecting lines of two oppositely located threaded holes 8 form a standing cross. The holes 8 can either be blind holes coming from both sides of the headpiece 7, or can pass through from one side to the other side of the headpiece 7, so that a right-hand thread results from the one side, and a left-hand thread of the holes results from the other side.

The headpiece 7 is covered by a hood 9 which can clamp onto the sides 10, 11; it is also possible to clamp that side wall 12 of the hood 9 remote from the observer, and/or that side wall 13 facing the observer, on the headpiece 7, or the hood 9 can be fastened on the headpiece 7 with other means. Furthermore, non-illustrated intermediate spaces and hollow spaces and means can be provided in order to guide communication and power lines within the hood 9.

The oppositely located walls 12, 13 of the hood 9 have coinciding round or, as illustrated, quadratic cutouts 14, 15 which, with the hood 9 installed on the headpiece 7, respectively occupy the positions 14', 15' around the two groups of quadratically arranged bores 8.

A bracket or fastening plate 16 is connected at each of the two ends of every bar 3,4 at a right angle thereto; the periphery of the fastening plate 16 corresponds to the recesses or cutouts 14, 15 of the hood 9 in such a manner that the fastening plates 16 can be fastened to the headpiece 7 in a manner which is to be described in further detail below, with three side edges of the fastening plates 16, for instance the side edges 17, 18, 19 (FIG. 2), being surrounded by the edges 20, 21, 22 (FIG. 5) which delimit the cutouts 14, 15.

The quadratic plate 16 has three smooth holes 23 having an arrangement which corresponds identically to the arranggment of three of the threaded holes 8 in the headpiece 7. A fourth hole, which would correspond to the fourth threaded bore of the quadratic arrangement of the threaded holes 8, is omitted. The diameter of the holes 23 is selected in such a way that a screw can be screwed through each hole 23 into the threaded holes 8. The three holes 23 are triangularly arranged, with the base line G thereof being located on the middle line M of the quadratic plates 16 and passing through the middle point O of the plate; in the position of the plate 16 according to FIG. 2, the end of the support bar 3 or 4 is connected with the plate 16 above this base line G. The support bars 3,4 are arranged double eccentrically with respect to the fastening plates 16; i.e., the cross sectional middle S of the support bars 3 or 4 is installed displaced or offset not only with respect to the horizontal middle line M in FIG. 2, but also with respect to the vertical middle line W. The fastening plate 16 can, for instance, be welded with the end faces of the support bars 3,4. It is also possible to provide the plate 16 with short profiled connecting pieces by means of which the bars 3,4 are telescopically pushed and fastened. Here, there is proceeded on the basis of the direct connection of the plate 16 with the ends of the bars 3,4.

The bars 3,4 have a rectangular cross section, for example of a size of 40 by 60 mm. As recognizable from FIGS. 2 and 3, the support surface 25 of the wall 24 of the bars3,4 is flush with or coincides with the top edge 17 of the plate 16, so that the support surface 25 is spaced from the lower edge 26 of the plate 16 by the distance a. If the plate 16 is turned or rotated in the direction of the arrow K, whereby again three screws are inserted through the holes 23 and are screwed into the threaded bores 8', 8'' and 8'' (FIG. 5), the bars 3, 4 come into the position 3', 4', whereby the support surface 28 of the wall 27 comes into the dot-dash line position according to FIG. 2, in which the support surface 28 now only has a spacing b from the then lower edge of the plate 16, comparison being made with the plate edge 29, which occupies the position of the edge 26 upon rotation of the plate by 90°. Upon further turning or rotation of the plate 16 by 90°, the support bars 3,4 come into the position 3'' and 4'', so that now the support surface 31 of the wall 30 only has a spacing c from the then lower edge of the plate 16.

If the plate is turned or rotated by 270° out of the starting position in the direction of the arrow K, the support bars 3,4 attain the position 3''', 4''', and the support surface 32 of the wall 33 reaches the spacing d from the then lower edge of the plate 16. Since that edge of the plate 16 which at any given time is the lower edge, because of the arrangement of the holes 23 and the threaded holes 8, always occupies the same position, different height or level positions, of the support surfaces of the bars from the ground or floor, result in different positions of these bars 3,4, upon which the table-top is placed.

As illustrated in FIG. 3, the table-top 5, in the vicinity of the edges 43, 44 (FIGS. 1 and 6*a*), has threaded bushings or sleeves 40, 41, 42 starting from the underside thereof. The arrangement of these threaded sleeves is such that the front longitudinal edge 45 and the rear longitudinal edge 46 of the table-top 5 are respectively flush with or coincide with the front or rear edges 47, 49, 48, 50 of the two hoods 9, irrespective of which height or level position is occupied by the table-top 5. Also with an inclined position of the table-top, as set forth in greater detail below, a very accurate termination or alignment of the table-top with the mentioned hood edges results. For this purpose, the bars 3,4 have bores 51, 52, 53, and 54 which are located at the same height and diametrically opposite to each other in pairs; and position of the bores in relation to the arrangement of the threaded sleeves 40, 41, 42, which are located on a transverse line of the table-top 5, is selected in such a way that threaded bolts can be inserted through the bores 51, 52 and screwed into the threaded sleeve 41 when the bars occupy the position 3,4, and 3'' and 4'' according to FIG. 2. A threaded bolt can be introduced through the bores 53, 54 into the threaded sleeve 40 when the bars occupy the position 3', 4', and a threaded bolt likewise can be introduced through the bores 53, 54 into the threaded sleeve 42 when the bars occupy the position 3''', 4''' according to FIG. 2. The indicated alignment of the front and rear edge of the table-top with the end faces 47, 48, 49, 50 of the hoods 9 results in the indicated positions of the bars and the described position of the connecting bolts of the bars with the threaded sleeves 40, 41, 42.

Figure 4:
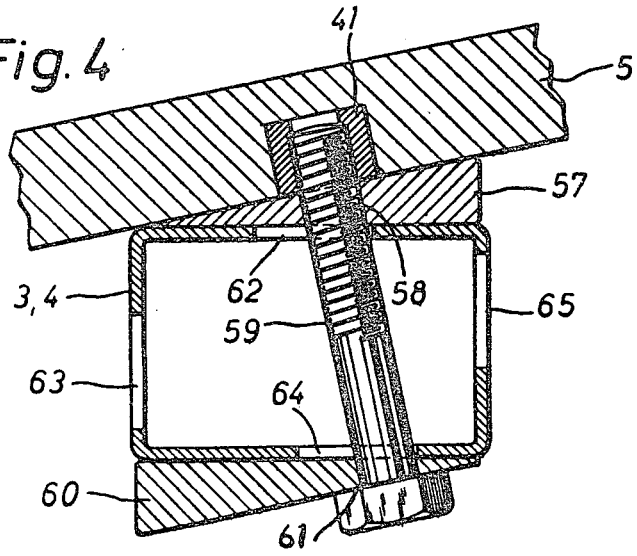
FIG. 4 shows an embodiment with which the table-top is installed in an inclined position.

The table-top 5 can have an inclined position with respect to the horizontal when the respectively upper support surface of the support bars 3,4 is provided with a wedge-shaped intermediate piece 57 (FIG. 4). This intermediate piece 57 has a correspondingly inclined bore 58 through which a bolt 59 is inserted. That side of the support bars 3,4 located opposite the support surface of the bars is provided with a wedge-shaped piece 60 having the same inclination as the intermediate piece 57, and having a bore 61. In order to take into account the inclined position of the bolt 59, the holes 51, 52, 53, and 54 in the embodiment according to FIG. 3 are widened toward one side as elongated or slotted holes 62, 63, 64, 65 respectively.

FIGS. 6*a*, 6*b* and 6*c* show three different height positions of the table-top 5. In the uppermost illustration of FIG. 6*a*, the table-top 5*a* occupies its highest position, for instance a height of 75 cm above the floor or the set-up surface of the table, whereby the support bars 3,4 occupy the position shown by solid lines in FIG. 2. In FIG. 6*b*, the table-top 5*b* occupies a height of, for example, 71 cm above the floor, and the support bars 3,4 occupy the position 3', 4' in FIG. 2. In the position according to FIG. 6*c*, the support plates 16, to which both support bars 3,4 are secured, have been rotated to such an extent that the bars occupy the position 3'', 4'' in FIG. 2, and the table-top 5*c* has a vertical height of for instance 68 cm. In the position 3''', 4''' of the support bars 3,4, the table-top 5 has a height of approximately 72 cm above the floor.

With the adjustment or setting of the table-top 5 according to FIG. 6*d*, the front support bar 3 is in the position 3' according to FIG. 2, while the rear support bar 4 occupies for instance the position 4''' according to FIG. 2; the table-top 5 thereby occupies an inclined position. In this case wedge-shaped intermediate pieces 57 are installed on the support surfaces 28 and 32 of the support bars 3,4. The table-top 5 rests on the pieces 57, and is secured by appropriate bolts 59 and the use of wedge-shaped pieces 60.

A double table made of two table-tops placed next to each other in the longitudinal direction requires only one middle leg from which the support bars project from both sides for the two table-tops. To cover the cutouts 14, 15 of the hood 9, which cutouts are initially visible on the outer side of the legs with a dual-leg table, suitable filler pieces 66 (FIG. 6*d*) are inserted into these cutouts 14, 15, and these are fastened with screws introduced into the threaded holes 8, so that a smooth outer side of the hoods 9 results.

The present invention is, of course, in no way restricted to the specific disclosure of the specification and drawings, but also encompasses any modifications within the scope of the appended claims.

What we claim is:

1. A worktable, set on a surface, and comprising:

two side legs, each being provided with threaded holes;

support bars rigidly interconnecting said side legs respectively; each support bar having at least two fastening and support surfaces respectively which extend substantially parallel to the axis of said support bar;

fastening plates respectively connected to the ends of each support bar at right angles to the axis of said support bar, and in particular being eccentrically connected with the ends of said support bar in such a way that when the two fastening plates of a given support bar are rotated, said fastening and support surfaces of that support bar are located at different heights above said surface upon which said worktable is set; each fastening plate being provided with holes which are equally spaced from, and are rotationally symmetrical to, the middle point of said fastening plate, with the centers of said holes lying on an imaginary circle of symmetry, and with a given one of said holes being equidistant from its adjacent holes as viewed along said imaginary circle of symmetry; said holes of said side legs being arranged in such a way as to correspond with said holes of said fastening plates in order to effect said interconnection of said side legs by said support bars;

a table-top supported directly on said fastening and support surfaces of said support bars; and fastening means provided on the underside of said table-top for holding the latter on said support bars.

2. A worktable according to claim 1, in which each support bar has a rectangular cross section.

3. A worktable according to claim 2, in which each fastening plate is square, and is provided with three holes arranged in the shape of a triangle, the base of which coincides with one of the middle lines of said fastening plate.

4. A worktable according to claim 2, in which at least two of said at least two fastening and support surfaces of said support bars extend parallel to side edges of said fastening plate.

5. A worktable according to claim 4, which includes four fastening and support surfaces formed by the walls of each support bar, said walls being provided with oppositely located bores for cooperation with said fastening means of said table-top.

6. A worktable according to claim 5, in which said fastening means of said table-top include threaded sleeves provided in the underside of said table-top.

7. A worktable according to claim 6, in which said oppositely located bores in oppositely located walls of each support bar are at least partially aligned.

8. A worktable according to claim 7, in which each fastening plate is connected to an end of its support bar by an arrangement which includes three threaded sleeves in the underside of said table-top, the spacing of said sleeves from the longitudinal edges of said table-top being the same as the spacinag of said bores of said walls of said support bars in their different positions when rotated.

9. A worktable according to claim 5, in which at least that fastening and support surface of each support bar which supports said table-top carries a wedge=shaped intermediate piece; and in which said bores of said walls of said support bars are elongated holes.

* * * * *